United States Patent [19]

Alberny et al.

[11] 4,040,467

[45] Aug. 9, 1977

[54] CONTINUOUS-CASTING SYSTEM WITH ELECTRO-MAGNETIC MIXING

[75] Inventors: Robert Alberny; Louis Vedda, both of Metz, France

[73] Assignee: Institut des Recherches de la Siderurgie Francaise, Saint-Germain-en-Laye, France

[21] Appl. No.: 723,647

[22] Filed: Sept. 15, 1976

[30] Foreign Application Priority Data

Sept. 19, 1975 France ..... 75.28702

[51] Int. Cl.[2] ..... B22D 11/10

[52] U.S. Cl. ..... 164/49; 164/82; 164/147; 164/250; 164/283 M

[58] Field of Search ..... 164/49, 82, 147, 250, 164/273 R, 283 M, 251

[56] References Cited

U.S. PATENT DOCUMENTS

| | | | |
|---|---|---|---|
| 3,804,147 | 4/1974 | Bobel et al. | 164/82 X |
| 3,941,183 | 3/1976 | Vedda et al. | 164/283 M X |
| 3,952,791 | 4/1976 | Ito et al. | 164/49 |
| 3,995,678 | 12/1976 | Zavaras et al. | 164/82 X |

FOREIGN PATENT DOCUMENTS

| | | | |
|---|---|---|---|
| 1,807,435 | 10/1970 | Germany | 164/49 |

*Primary Examiner*—Ronald J. Shore
*Attorney, Agent, or Firm*—Michael J. Striker

[57] ABSTRACT

A continuous-casting mold has two relatively long sides and two relatively short sides. Secured to each of the long sides is a box through which coolant is circulated, and in each of these boxes there is provided a plurality of horizontally spaced groups of vertically spaced inductors. Each of these groups is connected to a respective multiphase power supply so that the frequency and/or field strength of the respective magnetic field can be varied from group to group in order to eliminate dead zones within a body of metal being cast within the mold.

10 Claims, 4 Drawing Figures

PRIOR ART

CONTINUOUS-CASTING SYSTEM WITH ELECTRO-MAGNETIC MIXING

CROSS-REFERENCE TO RELATED APPLICATION

This application is related to the copending and commonly assigned U.S. patent application Ser. No. 471,972, now U.S. Pat. No. 3,981,345, and Ser. No. 723,194 respectively filed 21 May 1974 and 14 Sept. 1976.

BACKGROUND OF THE INVENTION

The present invention relates to a method of and an apparatus for the continuous casting of steel. More particularly this invention concerns a system for electromagnetically mixing the molten steel in a continuous-casting process.

In the continuous casting of metal an upwardly and downwardly open tubular mold is used into which the molten metal is poured. The walls or sides of the mold are cooled so that the metal solidifies in this mold at least in an outer skin before it withdraws from the lower end of the mold. The interior of the workpiece in the mold at least is still liquid and forms a so-called crater. The sides of the mold are normally made of highly conductive material such as copper in order to maximize heat exchange between the casting being continuously formed and the mold which itself is normally cooled by means of water.

The main problem in continuous-casting operations is that due to thermal contraction the skin of the casting separates from the mold so that the rate of heat extraction from the casting is relatively low. Furthermore, the casting produced by this method often is inadequately homogeneous so that it cannot be used for the production of many types of metals, in particular steel.

It has been found possible to partly solve some of these problems by providing on at least one of the sides of the mold a heavy-duty inductor whose magnetic field passes through the casting and produces eddy currents that serve to mix the molten metal in the casting, thereby increasing homogenity of the casting so produced and also augmenting heat exchange. Thus it is possible to produce a high-quality bloom, slab, or billet even with steels that have hitherto often been considered unsuitable for continuous casting.

In most arrangements the molten steel is introduced into the continuous-casting mold by means of a conduit whose lower outlet end lies below the surface of the metal in the mold. In order to maximize mixing or circulation within the mold such a conduit is normally provided with laterally opening orifices so that the molten metal is squirted laterally out of the conduit into the body in the mold. This augments the standard convection currents in the mold so that the impurities in the circulating metal are brought to the surface and there trapped in the layer of slag on the melt.

In practice such a system is not highly effective. Almost invariably dead regions are left in the mold where there is little circulation so that any impurities carried by the steel at this point will be left in the casting as inclusions that considerably impair the quality of the metal. Since the molten metal is inherently introduced into the mold at a relatively slow rate it is impossible to obtain by simple convection or flow currents caused by the injection direction sufficient circulation within the mold to cause most of the impurities to be trapped in the slag.

The above-described system using inductors which mix the melt does somewhat increase the exchange of impurities from the metal to the slag. Nontheless, it is noted that very frequently the melt at side regions of the mold in systems wherein the metal-introducing conduit opens toward the end walls is insufficiently mixed so that the resultant casting has many quality-impairing inclusions.

SUMMARY OF THE INVENTION

It is therefore an object of the present invention to provide an improved continuous-casting method and apparatus.

Yet another object is to provide such a system wherein the liquid metal is mixed in such a manner that impurities in the metal can be captured in the slag on top of the body of metal in the mold.

Yet another object is to provide such an arrangement wherein dead spots of low or nonexistent metal circulation are eliminated.

These objects are attained according to the present invention in a continuous-casting method wherein a plurality of independent magnetic fields of respective field-strength characteristics are formed at a plurality of respective horizontally spaced locations along at least one of the long walls of the mold. Each of these fields is continuously displaced vertically with a respective speed characteristic. At least one of these characteristics of each of the fields is varied relative to the corresponding characteristics of the other fields to vary the electromagnetic mixing effect in the metal along the long wall thereof. This is best done according to the present invention by providing a plurality of horizontally spaced groups of vertically spaced inductors in the cooling boxes provided on each of the long walls of the mold. Supply means in the form of electrical current sources are connected to each of the groups of inductors so as to energize them independently of the other groups.

According to further features of this invention each of the supply means is a polyphase electric-current source connected to the respective group of inductors. The arrangement is set up so that the number of inductors is equal to the number of phases or a whole-number multiple thereof. The various inductors are wired to the respective source in such a manner that the field sweeps from bottom to top. The field strength can be varied by varying the voltage and/or the current flowing through the inductors of each group.

According to the present invention those inductors closest to the center of the long walls of the mold are operated either at a higher frequency or at higher field strength than the other inductors in order to insure good mixing even in these wall regions.

According to yet another feature of this invention a plurality of rigid metallic elements is provided in the cooling box attached to the long side of the tube forming the mold. These elements are braced between the one side of the mold and the opposite side of the box so as to form a rigidifying connection therebetween. A coil is wound on each of these elements so that these elements serve also as the cores of the coil. Such double use of the rigidifying struts therefore allows a very compact mold to be formed which is nonetheless quite rigid while having a heavy-duty built-in electromagnetic inductor arrangement.

According to further features of this invention the metallic elements forming the coil cores extend horizontally and perpendicular to the respective sides of the tube. This side of the tube is formed, as mentioned above, of copper or a copper alloy and no magnetic material is interposed between these elements and the side of the mold. At their other ends these core elements are in contact with a magnetic, preferably ferromagnetic, plate which closes the outside of the magnetic circuit and which is clamped to the core elements by means of bolts serving as struts passing through the core elements. These bolts are anchored at one end in the nonmagnetic side of the mold and at their other ends are in the ferromagnetic plate.

According to yet another feature of the present invention the core elements are each formed as a flat plate having a flared end extending toward and engaging the side of the mold. Each of these plates is symmetrical about a horizontal plane and extends generally horizontally. The coils are wound around them so that these coils are of parallelopipedal shape.

It is also possible in accordance with this invention to form each of the poles as a generally cylindrical pin, once again having a flared end extending toward and engaging the side of the mold. Cylindrical coils are wound around each of these pins.

There is provided between each of the coils and its respective core element and between adjacent coils a plurality of hard epoxy-resin spacers which allow the coolant circulating through the chamber formed by the cooling box to pass between these various parts and cool them. Furthermore in accordance with this invention a nonmagnetic plage may lie against the side of the mold and be formed with throughgoing holes in which are fitted the flared ends of these core elements. Such a nonmagnetic plate may have holes at its top and/or bottom that communicate with vertical slots in the mold side so that liquid can flow up through this mold side and act as the coolant.

With the system according to this invention it is therefore possible to provide an extremely powerful magnet inside the cooling box, while at the same time allowing a great deal of support to suitably rigidify the side of the mold. Such a structure has been found to facilitate the continuous casting of many types of steel which have hitherto not been castable in a continuous process. In particular, the excellent mixing obtained allows impurities to rise to the surface and often eliminates the necessity for flames scorching the blooms, slabs, or billets produced by this method.

Furthermore, with the system according to the present invention it is possible to achieve the exact mixing effect desired, completely eliminating any dead zones within the melt. Thus impurities likely to form inclusions in the casting are brought to the surface where they are dropped in the slag floating thereon so that an extremely high-quality and homogeneous casting is produced.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

SPECIFIC DESCRIPTION OF A PREFERRED EMBODIMENT

Figure 1:
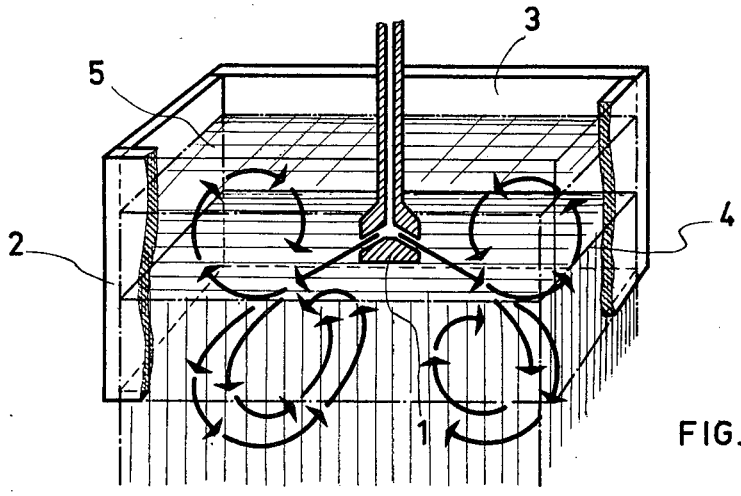
FIG. 1 is a perspective view of a mold without electromagnetic mixing.

The prior-art mold shown in FIG. 1 has a pair of end walls 2 that are relatively short and a pair of side walls 3 that are relatively long. A conduit 1 of refractory material has laterally opening outlets directed toward the end walls 2 so as to form currents indicated at 4 in a body 5 of molten steel in the mold. With this system it is therefore apparent that there is little current toward the side walls 3 so that here there will be relatively modest mixing and impurities in the metal will form inclusions rather than joining the slag floating on top of the body 5. Indeed, the only current in these lateral regions is a continuous downward current as the casting or ingot is pulled out of the bottom of the mold.

Figure 3:
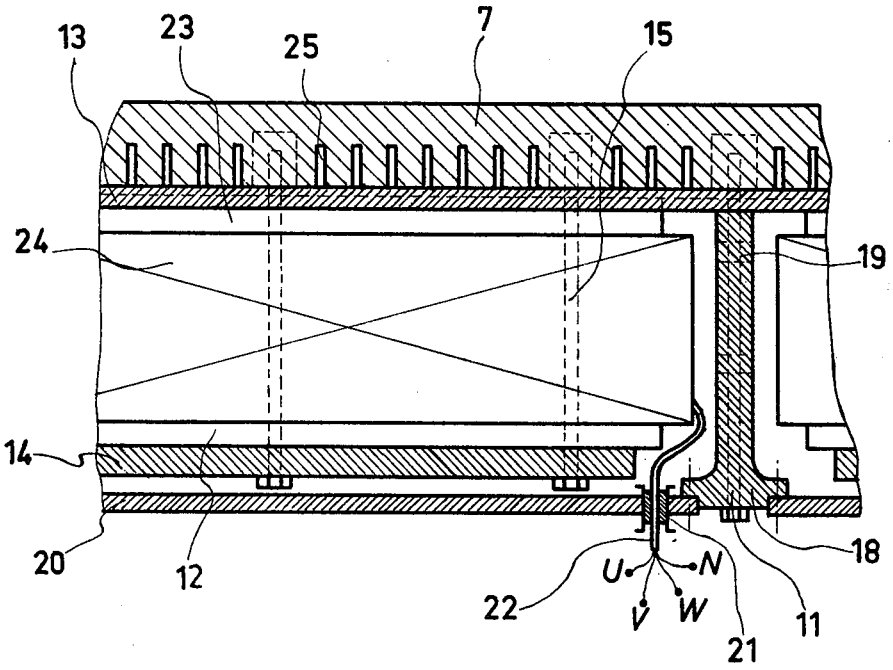
FIG. 3 is a section taken along plane III—III of FIG. 2.
Figure 2:
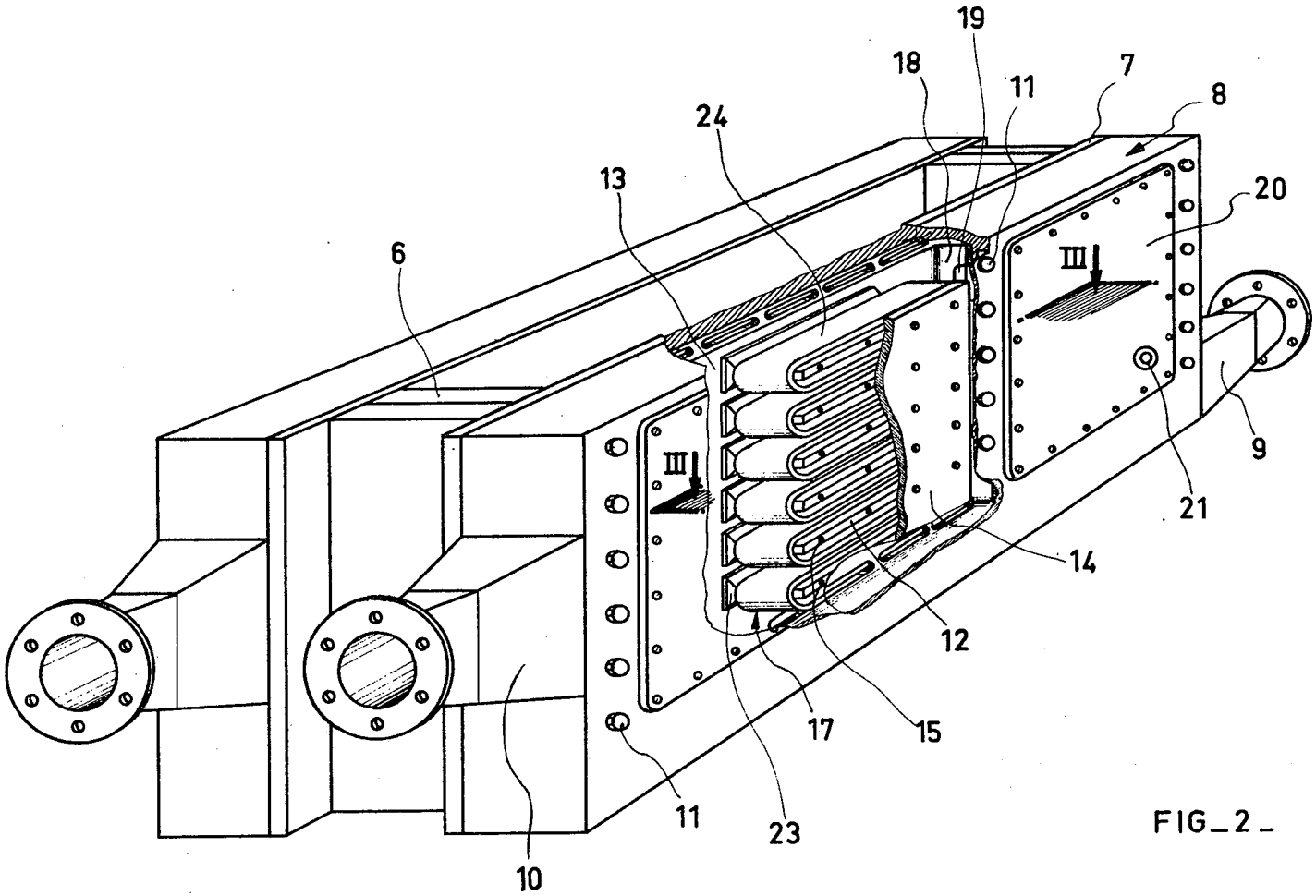
FIG. 2 is a perspective partly broken away view of the molding apparatus according to this invention.
Figure 4:
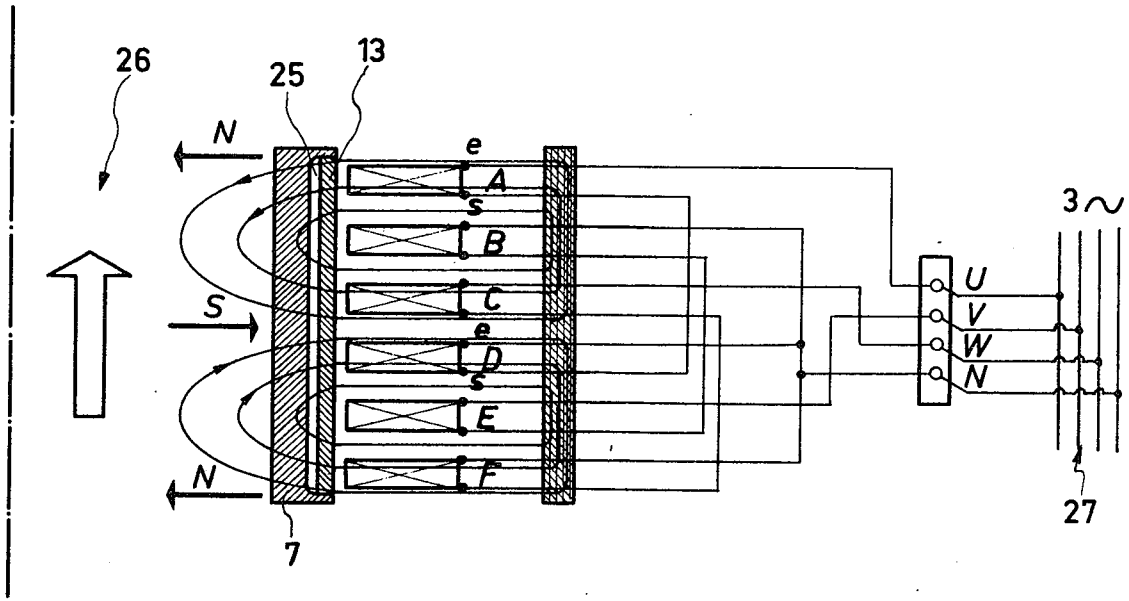
FIG. 4 is a vertical section partly in schematic form through the detail shown in FIG. 3.

As shown in FIGS. 2 – 4 a mold has a pair of relatively long side walls 7 and relatively short end walls 6 that form an upwardly and downwardly open tube suitable for the continuous casting of steel such as described on pages 664–666 of *The Making, Shaping, and Treating of Steel* (U.S. Steel: 1964). Each of the walls 7 is provided with a parallepipedal cooling box 8 having at the bottom of its one end an inlet 9 and at the middle of its other end an outlet 10 so that water can be circulated through the box 8 and a cooler by means of a pump. The walls 6 and 7 are made of a highly conductive but non-magnetic copper alloy so that molten steel can be poured into the top of the tube formed by these walls 6 and 7.

A plurality of struts or bolts 11 secure the box 8 to the respective sides 7 and three removable cover plates 20 are held thereagainst by means of bolts around the peripheries. The interior of each box 8 is subdivided into an inlet compartment and an outlet compartment. The inlet compartment is formed as a square-section steel tube secured as mentioned above by bolts 11 to the wall 7 and formed along its lower edge with a plurality of laterally throughgoing slots. The wall 7 is formed with a plurality of vertical grooves 25 shown best in FIG. 3 which allow the water introduced via the inlet pipe 9 to flow upwardly along this wall 7 and cool it. At their top ends these slots 25 communicate via horizontal slots in a lip of the upper plate of the box 8 with the compartment at the upper region thereof. The outlet compartment is defined between a nonmagnetic plate 13 overlying the wall 7 at the slots 25 and a ferromagnetic plate 14. The plate 13 is formed with three groups of six slots in which are seated flared ends 23 of ferromagnetic core elements 12 on which coils 24 are mounted via spacers.

Further struts or tiebolts 15 are provided which extend through these elements 12 and are threaded at one end into plugs of nonmagnetic material threaded into the wall 7 and at their other ends are provided with nuts that clamp the elements 12 – 14 together. Seals are provided between the plate 13 and the inlet compartment and lip of the upper plate of the box 8. Another seal is provided between the wall 7 and the upper plate of the box 8, and a seal is provided between this plate and each of the cover plates 20. The elements 12 and 14 are made of ferromagnetic steel or iron. On the contrary the elements 13 and 15 are made of nonmagnetic steel, preferably of the stainless type.

The plates 12 are symmetrical about horizontal planes and may be formed as stacks of soft-iron sheets. The plugs in which the ends of the bolts 15 are mounted are received in ridges or lands formed between the vertical grooves 25 as best shown in FIG. 3. This construction insures that the entire assembly is extremely rigid, yet the magnet fields can extend well into the mold, through the wall 7, whereas it is confined by the plate 14.

When a stack of sheets is used to form the elements 12 the sheets of the stack will lie in plane parallel to the lines of force. The plate 14 may similarly be made of a stack of such soft-iron sheets. The inductors are divided into magnetically independant groups 17. The outlet compartment in which the 18 elements 12 carrying their respective coils 24 is provided with vertical ferromagnetic partitions 18 formed with throughgoing holes 19. Thus coolant can flow through the outlet compartment constituted by the upper portion of each of the boxes 8, but the fields of each of the groups 17 of inductors 12, 24, is maintained independent of the fields of the other groups. In addition each of the cover plates 20 is provided with a feedthrough 21 for the cable 22 from the coils 24 of the respective groups 17.

As best shown in FIG. 4, associate with each of the groups 17 is a respective three-phase electrical power supply 27 having a neutral line N and three phases U, V and W, arranged in a Y-configuration. The individual coils 24 are indicated in descending order at A – F and each have a lower feedline *s* and an upper feedline *e*. Since six such coils 24 are provided in each group each of the coils A, B, and C is connected in series with a respective coil D, E, and F across the respective phase U, V, or W. Thus the *e* line of coil A is connected directly to U, whereas *s* line is connected to the *s* line of coil D, whose line *e* in turn is connected to the ground line N. The other coils B, C, E and F are correspondingly connected so as to form three poles which will move upwardly as indicated at 26. This causes the field created by the group 17 to continuously sweep upwardly at a speed determined by the frequency of the source 27. Clearly, the strength of the field will be determined by the voltage and/or amperage of the source 27.

This field which moves upwardly along each of the walls 7 serves to electromotively displace the metal 26 adjacent this wall 7. The principal magnetic flux which passes through the nonmagnetic plate 13 induces eddy or Foucault currents in the metal 26. The magnetic flux caused by these currents slides relative to the inductor and relative to the molten metal, but remains immobile relative to the principal flux. The interaction of these two fluxes, principal and induced, creates an upwardly effective linear displacement of the metal.

Since each of the groups 17, three of which are provided on each wall 7, is independently fed with its own multi-phase electrical source, it is possible to vary the electromotive forces effective on the metal so as to eliminate dead regions as described above. Autotransformers, induction-type voltage regulators, thyristor voltage-regulating circuits, or even motor-generators can be used as the sources 27. In addition, the effect can readily be changed by varying the connections to the various coil 24. It is also relatively easy to transform this system for use with a delta supply rather than Y-type supply. The current can vary by as much as several hundred amperes from one group 17 to the next. It is also possible to change the frequency by means of static converters or rotating elements. The reduction of frequency has the effect of increasing the depth of penetration of the sliding magnetic field. In practice it has been found that the best frequency lies between 0.1 and 20 Hz.

The arrangement described above can also be used with cylindrical coils and cores, as described in the above-cited copending application whose entire disclosure is herewith incorporated by reference.

It will be understood that each of the elements described above, or two or more together, may also find a useful application in other types of system differing from the types described above.

While the invention has been illustrated and described as embodied in a continuous-casting molding and apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a method of continuous casting wherein molten metal is poured into the top of a mold formed as an upright tube having at least one relatively long upright wall, the improvement comprising:

forming a plurality of independent magnetic fields of respective field-strength characteristics at a plurality of respective horizontally spaced locations along said long wall;

displacing each of said fields continuously vertically with a respective speed characteristic; and varying at least one of the characteristics of each of said fields relative to the corresponding characteristics of the other fields to vary the electromagnetic mixing effect in said metal along said long wall.

2. The improvement defined in claim 1 wherein said mold has a pair of such long walls joined by a pair of short walls, each of said long walls having a plurality of such longitudinally spaced fields.

3. The improvement defined in claim 2 wherein said fields are created electromagnetically.

4. The improvement defined in claim 3 wherein said molten metal is introduced at a central region of said long walls, the strength characteristics of said fields closest said central region being varied to be substantially stronger than the other strength characteristics.

5. The improvement defined in claim 4 wherein said strength characteristics are varied by varying current flow through coils forming said fields.

6. The improvement defined in claim 3 wherein the speed characteristics of said fields closest said central region are varied for faster upward field movement at said region.

7. A continuous-casting apparatus comprising:

an upright tubular mold having a pair of long walls and a pair of short walls, whereby molten metal can be poured into the top of said mold and an ingot withdrawn from the bottom thereof continuously;

a hollow cooling box on each of said long walls;

means including respective inlets and outlets for passing a fluid coolant through said boxes thereby cooling said long walls;

a pluality of horizontally spaced groups of vertically spaced inductors in each of said boxes, each of said inductors being energizable to form a field having a respective strength characteristic and movable with a predetermined speed characteristic; and supply means for each of said groups for energizing the respective groups and varying at least one of the characteristics thereof relative to the corresponding characteristics of the other groups.

8. The apparatus defined in claim 7 wherein each of said supply means is a polyphase electrical current source.

9. The apparatus defined in claim 8 wherein said inductors are each connected to their respective current sources in such manner that the respective field is displaced upwardly with said speed characteristic, said speed characteristic being dependent on frequency and said strength characteristics being dependent on electrical energization level.

10. The apparatus defined in claim 9, further comprising means for introducing molten steel into said mold adjacent central regions of said long walls, said inductors at said central regions being energized so that the electromotive force exerted at said central regions is greater than remote from said central regions.

* * * * *